US011566502B2

(12) United States Patent
Enerstvedt et al.

(10) Patent No.: US 11,566,502 B2
(45) Date of Patent: Jan. 31, 2023

(54) GAS LIFT SYSTEM

(71) Applicant: WEATHERFORD TECHNOLOGY HOLDINGS, LLC, Houston, TX (US)

(72) Inventors: Eirik Enerstvedt, Sandnes (NO); Nisha N. Shanmugam, Kuala (BN); Bjørnar Sneeggen, Sola (NO); Sondre Klakegg, Sandnes (NO)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 17/344,068

(22) Filed: Jun. 10, 2021

(65) Prior Publication Data

US 2022/0397023 A1 Dec. 15, 2022

(51) Int. Cl.

| | |
|---|---|
| ***E21B 17/04*** | (2006.01) |
| ***E21B 23/06*** | (2006.01) |
| ***E21B 43/12*** | (2006.01) |

(52) U.S. Cl.

CPC ..... *E21B 43/123* (2013.01); *E21B 17/04* (2013.01); *E21B 23/06* (2013.01)

(58) Field of Classification Search

CPC ..... E21B 17/04; E21B 23/06; E21B 43/123
See application file for complete search history.

(56) References Cited

U.S. PATENT DOCUMENTS

| | | | | |
|---|---|---|---|---|
| 3,675,714 | A | 7/1972 | Thompson | |
| 3,884,299 | A * | 5/1975 | McCarter | F04F 1/18 417/109 |
| 5,501,279 | A * | 3/1996 | Garg | E21B 43/006 166/372 |
| 6,367,555 | B1 * | 4/2002 | Senyard, Sr. | E21B 43/122 166/372 |
| 6,973,973 | B2 | 12/2005 | Howard et al. | |
| 7,311,152 | B2 | 12/2007 | Howard et al. | |
| 7,445,049 | B2 | 11/2008 | Howard et al. | |
| 7,770,637 | B2 | 8/2010 | Phoi-Montri et al. | |
| 7,954,551 | B2 | 6/2011 | Bolding | |
| 9,470,074 | B2 | 10/2016 | Bolding et al. | |
| 10,858,921 | B1 | 12/2020 | Juenke et al. | |
| 2009/0194294 | A1 | 8/2009 | Williams | |

(Continued)

OTHER PUBLICATIONS

Weatherford; "Retrofit Deep Gas Lift", 37th Gas-Lift Workshop presentation, dated Feb. 3-7, 2014, 25 pages.

(Continued)

*Primary Examiner* — Matthew R Buck
(74) *Attorney, Agent, or Firm* — Smith IP Services, P.C.

(57) ABSTRACT

A system can include a completion string with a tubing and a dip tube secured in the tubing. A gas is injected into an annulus between the tubing and the dip tube, and the gas and well liquids flow into the dip tube. A method can include installing a completion string including a tubing, a dip tube in the tubing, and a packer downhole of a gas lift valve, and flowing a gas into the tubing via the gas lift valve, into an annulus between the tubing and the dip tube, and then into the dip tube. Another system can include a tubular connector connected between adjacent sections of the tubing, with the dip tube secured in the tubing and connected to the tubular connector. A gas flows from the gas lift valve to the annulus via a gas flow path formed in the tubular connector.

18 Claims, 7 Drawing Sheets

(56) References Cited

U.S. PATENT DOCUMENTS

| | | | | |
|---|---|---|---|---|
| 2011/0214880 | A1 | 9/2011 | Rogers | |
| 2020/0270975 | A1 * | 8/2020 | Whiteman | E21B 43/34 |

OTHER PUBLICATIONS

Weatherford; "WidePak Deep Gas-Lift System", company article No. 12087.00, dated 2015, 1 page.
UK Search Report dated Sep. 22, 2022 for UK Patent Application No. GB2206116.2, 3 pages.

* cited by examiner

GAS LIFT SYSTEM

BACKGROUND

This disclosure relates generally to equipment utilized and operations performed in conjunction with a subterranean well and, in an example described below, more particularly provides an artificial lift system of the type known to those skilled in the art as a gas lift system, and associated methods.

In a well used to produce liquids from a subterranean formation, the liquids may not be able to flow unassisted to the earth's surface, due to various factors. For example, pressure in the formation may not be sufficient to overcome hydrostatic pressure in the well.

In situations where the liquids cannot flow unassisted to the surface, techniques known to those skilled in the art as "artificial lift" may be used to produce the liquids to the surface. One such artificial lift technique is known as "gas lift," in which a gas is injected into the liquids in the well, so that a density of the liquids is reduced.

It will, therefore, be readily appreciated that improvements are continually needed in the art of constructing and utilizing gas lift systems for producing liquids from wells. It is among the objects of the present disclosure to provide such improvements to the art.

DETAILED DESCRIPTION

Figure 1:
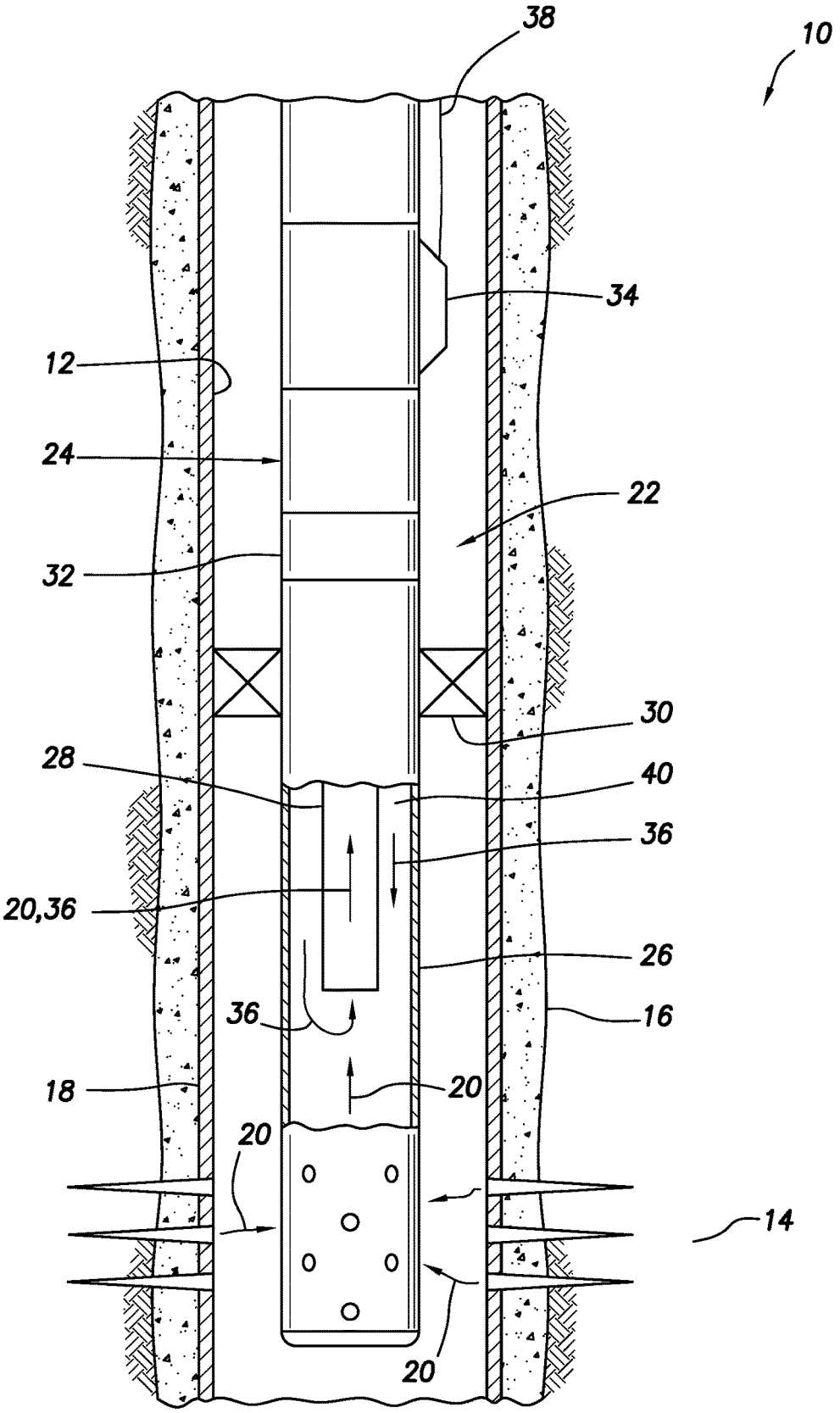
FIG. 1 is a representative partially cross-sectional view of an example of a well system and associated method which can embody principles of this disclosure.

Representatively illustrated in FIG. 1 is a well system 10 and associated method which can embody principles of this disclosure. However, it should be clearly understood that the well system 10 and method are merely one example of an application of the principles of this disclosure in practice, and a wide variety of other examples are possible. Therefore, the scope of this disclosure is not limited at all to the details of the well system 10 and method described herein and/or depicted in the drawings.

In the FIG. 1 example, a wellbore 12 has been drilled so that it penetrates a subterranean formation 14. The wellbore 12 is lined with cement 16 and casing 18. In other examples, a section of the wellbore 12 in which the principles of this disclosure are practiced may not be lined with cement or casing, but may instead be uncased or open hole.

As used herein, the term "casing" is used to indicate a protective wellbore lining. A casing can comprise any of a variety of tubulars known to those skilled in the art as casing, liner, tubing or pipe.

As depicted in FIG. 1, the cement 16 and casing 18 are perforated, so that liquids 20 can flow from the formation 14 into the wellbore 12. In other examples, a perforated or slotted liner may be used for the casing 16 (so that there is no need for perforating the casing), or the section of the wellbore may be uncased.

The liquids 20 may in various examples comprise oil, gas condensate, other liquid hydrocarbons, water, etc. Some gas and/or solids (such as, sand, fines, debris, etc.) may be entrained with the liquids 20, as well.

In this example, the liquids 20 will not flow unassisted to the surface. To produce the liquids 20 to the surface, a gas lift system 22 is installed in the well. The gas lift system 22 may be installed in the well when it is first completed, or the gas lift system may be installed after original completion (such as, when the liquids 20 can no longer be produced to the surface naturally due to decreased formation pressure).

The gas lift system 22 can have a variety of different configurations. In the FIG. 1 example, the gas lift system 22 includes a generally tubular completion string 24. The completion string 24 as depicted in FIG. 1 includes production tubing 26, a dip tube 28 secured in an interior of the production tubing, a packer 30 for sealing off against an interior of the casing 18 (or a wall of the wellbore 12 if the wellbore is uncased), a tubular connector 32 for securing the dip tube in the production tubing, and a side pocket mandrel 34 for communicating a gas 36 into the completion string.

In other examples, more, fewer or different components may be included in a completion string incorporating the principles of this disclosure. Thus, the scope of this disclosure is not limited to any particular components, number of components or configuration of components in the completion string 24 examples as described herein or depicted in the drawings.

The gas 36 is transmitted to the side pocket mandrel 34 through a relatively small tubing or control line 38 connected to the side pocket mandrel 34 and extending to the surface. In this example, a gas lift valve (not shown in FIG. 1, see FIG. 2) is installed in the side pocket mandrel 34 for regulating a flow of the gas 36 into the completion string 24. In other examples, the gas 36 may be introduced into the completion string 24 by means other than a control line, side pocket mandrel and gas lift valve.

As depicted in FIG. 1, the gas 36 flows into the completion string 24, through the tubular connector 32, and through an annulus 40 formed radially between the production tubing 26 and the dip tube 28. A lower section of the production tubing 26 is perforated, so that the liquids 20 can flow from the wellbore 12 into the production tubing.

Below a distal end of the dip tube 28, the gas 36 mixes with the liquids 20 in the production tubing 26. The combined liquids and gas 20, 36 flow upwardly through an interior of the dip tube 28, and then to the surface via the production tubing 26.

In the FIG. 1 example, the side pocket mandrel 34 is advantageously positioned uphole (closer to the surface along the wellbore 12) of the packer 30. In this position of the side pocket mandrel 34, the control line 38 or other gas conduit is not required to pass through the packer 30 and the gas lift valve is more accessible for retrieval and replacement. However, the side pocket mandrel 34 could be positioned downhole (farther from the surface along the wellbore 12) of the packer 30, if desired.

The tubular connector 32 is positioned longitudinally between the side pocket mandrel 34 and the packer 30 in the completion string 24 example depicted in FIG. 1. In other examples, the tubular connector 32 could be positioned downhole of the packer 30 (e.g., the packer could be positioned longitudinally between the side pocket mandrel 34 and the tubular connector). Thus, the scope of this disclosure is not limited to any particular arrangement of the completion string 24 components.

Figure 2:
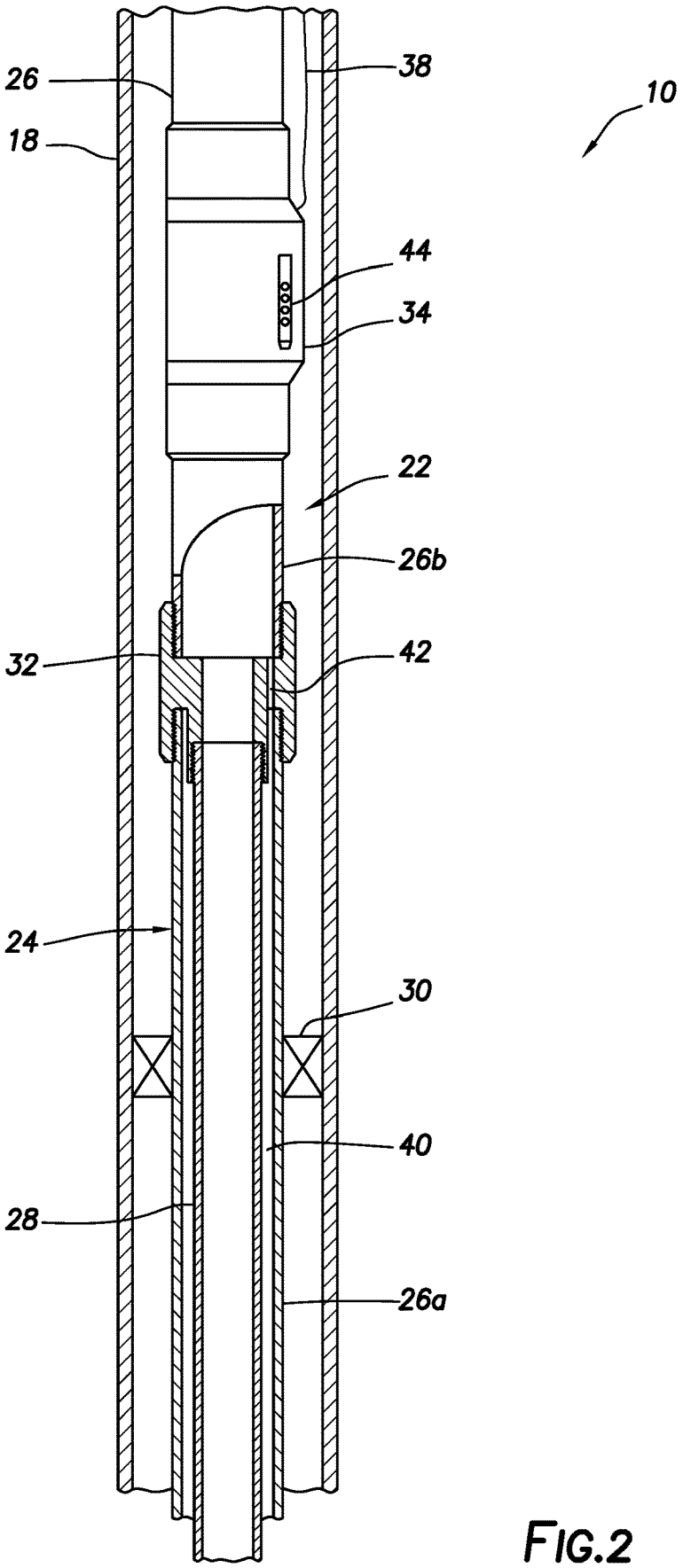
FIG. 2 is a representative partially cross-sectional view of an example of a portion of a completion string in the well system of FIG. 1.

Referring additionally now to FIG. 2, a more detailed view of an example of the completion string 24 in the FIG. 1 well system 10 is representatively illustrated. Only the casing 18 of the well system 10 is depicted in FIG. 2 for clarity. The completion string 24 may be used in well systems and methods other than the FIG. 1 well system 10 and method in other examples.

The manner in which the dip tube 28 is secured in the production tubing 26, and the manner in which adjacent sections 26*a,b* of the production tubing are connected together, using the tubular connector 32 can be seen in FIG. 2. Connections between the tubular connector 32 and each of the dip tube 28 and the production tubing sections 26*a,b* may be formed by threading, welding or any other suitable technique.

The tubular connector 32 has a gas flow path 42 formed therein. The gas flow path 42 is in communication with the annulus 40 between the dip tube 28 and the production tubing section 26*a*. As described more fully below, the gas flow path 42 permits the gas 36 (see FIG. 1) to flow to the annulus 40 from the gas lift valve 44 in the side pocket mandrel 34 when an inner string (not shown in FIG. 2, see FIG. 3) is installed in the completion string 24.

Figure 3:
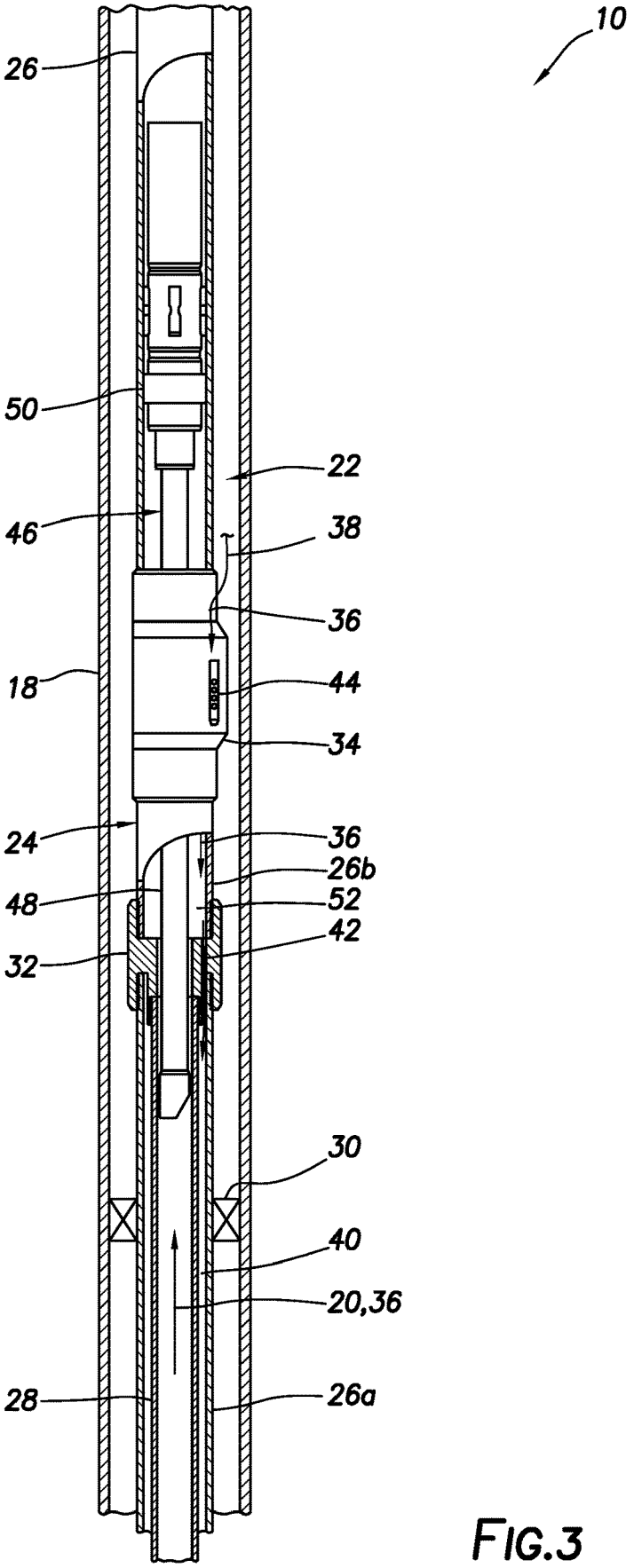
FIG. 3 is a representative partially cross-sectional view of the FIG. 2 completion string in the FIG. 1 well system, with an example of an inner string installed in the completion string.

Referring additionally now to FIG. 3, an example of the generally tubular inner string 46 is depicted installed in the completion string 24. Advantageously, the inner string 46 may be installed only when the gas lift system 22 is needed to lift the liquids 20 to the surface (i.e., the inner string need not be present in the completion string 24 when or if the liquids can flow to the surface naturally). In addition, the inner string 46 can be installed and retrieved relatively quickly and conveniently using conventional wireline conveyance techniques.

For example, after the gas lift system 22 has been operational for an extended period of time, it may become necessary to service or replace the gas lift valve 44. In that situation, the inner string 46 can be easily retrieved from the well, the gas lift valve 44 can be retrieved, serviced or replaced and then installed in the side pocket mandrel 34, and the inner string can then be installed in the completion string 24.

However, it should be understood that the above listed advantages of the inner string 46 and completion string 24 are not strictly necessary in a gas lift system incorporating the principles of this disclosure. More, fewer or different advantages may be present in other gas lift system examples incorporating the principles of this disclosure.

As depicted in FIG. 3, the inner string 46 includes a tubular stinger 48 and a packer 50. When installed in the completion string 24 as depicted in FIG. 3, the packer 50 is set, so that it seals off against an interior of the production tubing 26 above the side pocket mandrel 34.

The stinger 48 extends downwardly from the packer 50 and through the tubular connector 32 into the dip tube 28. In other examples, the stinger 48 may not extend into the dip tube 28, but could instead be received in a suitable receptacle in the tubular connector 32. An annular seal could be provided on the stinger 48 (such as, at a distal end thereof) to seal within the tubular connector 32 or the dip tube 28.

An annulus 52 is formed radially between the stinger 48 and the production tubing section 26*b*. This annulus 52 provides a flow passage for communicating the gas 36 from the side pocket mandrel 34 to the tubular connector 32. The gas 36 can flow from the annulus 52 to the annulus 40 via the gas flow path 42 in the tubular connector 32.

Figure 4:
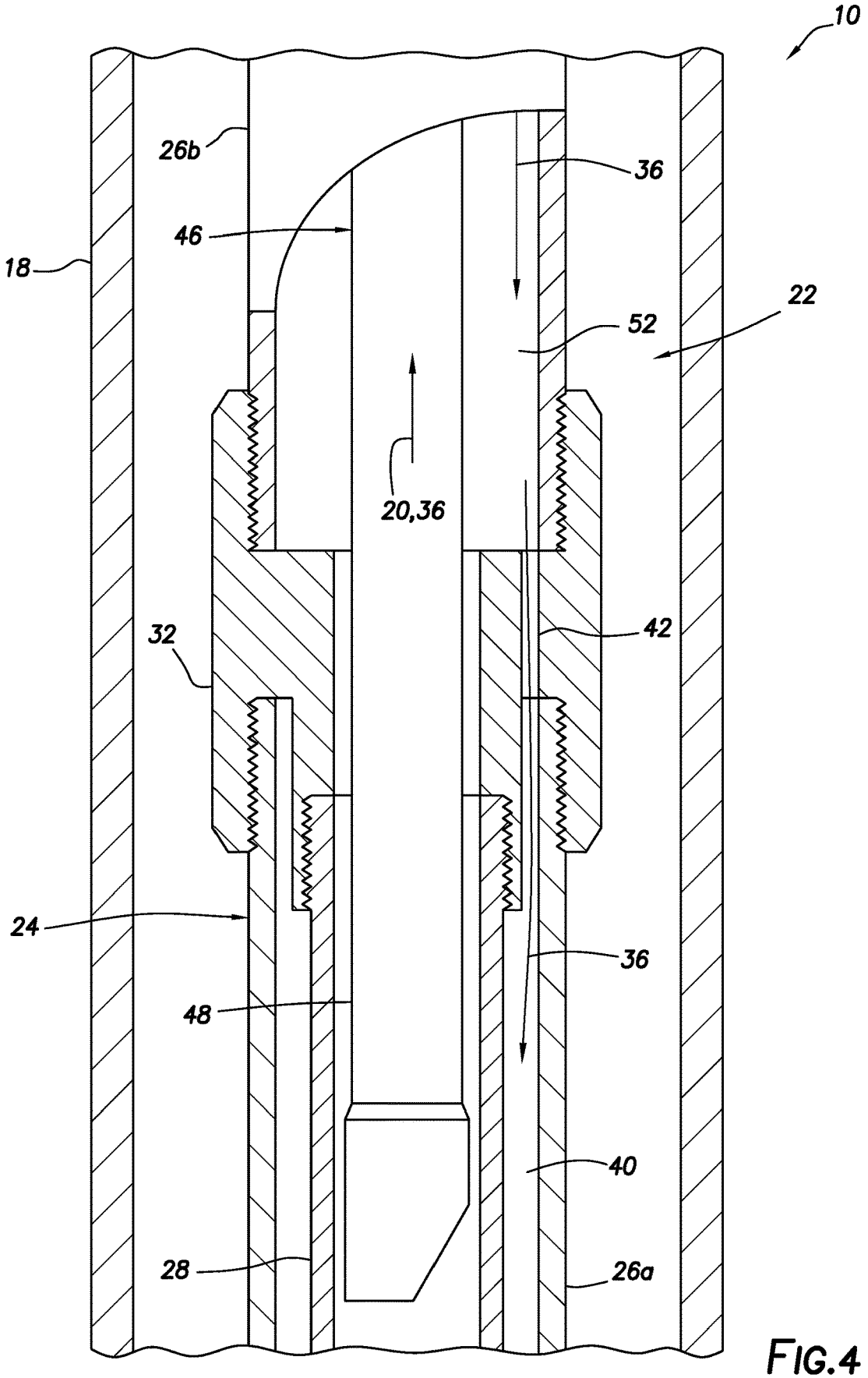
FIG. 4 is a representative partially cross-sectional view of a tubular connector of the completion string, with the inner string installed therein.

Referring additionally now to FIG. 4, an enlarged partially cross-sectional view of a portion of the gas lift system 22 in the casing 18 is representatively illustrated. In this view, the manner in which the gas 36 flows from the annulus 52 to the annulus 40 via the gas flow path 42 in the tubular connector 32 can be more clearly seen.

Figure 5:
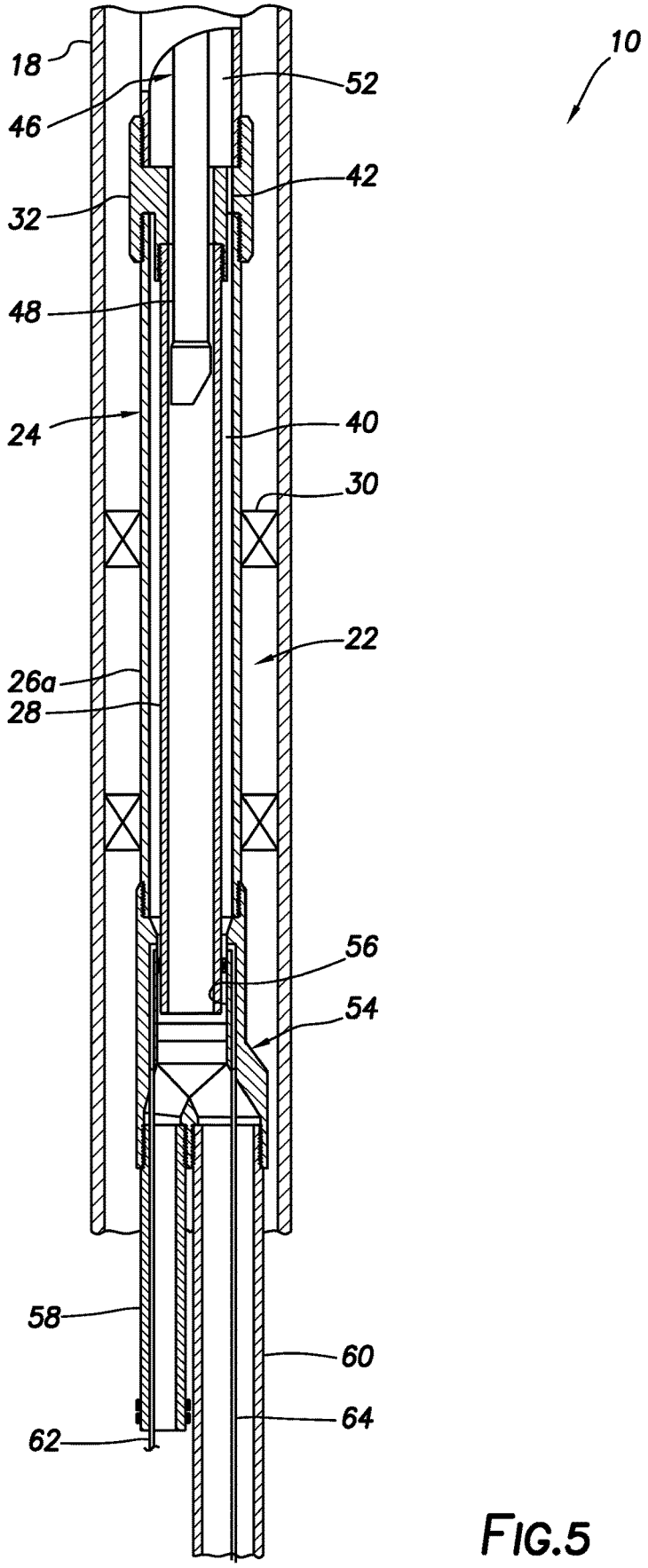
FIG. 5 is a representative partially cross-sectional view of another example of the completion string, with the inner string installed therein.

Referring additionally now to FIG. 5, a partially cross-sectional view of another example of the gas lift system 22 is representatively illustrated. An upper portion of the completion string 24 and the inner string 46 are not shown in FIG. 5, but these are the same for the FIG. 5 example as for the FIGS. 2-4 example described above.

As depicted in FIG. 5, an inverted Y-shaped connector (or "Y-connector") 54 is connected to a lower end of the production tubing 26. A lower end of the dip tube 28 is sealingly received in a bore 56 of the Y-connector 54.

Generally tubular legs 58, 60 are connected to a lower end of the Y-connector 54. As described more fully below, the legs 58, 60 are configured for deployment into respective intersecting wellbores, such as, in a well completion known to those skilled in the art as a "multilateral" completion. Threading, welding or other means may be used to connect the production tubing 26 and the legs 58, 60 to the Y-connector 54.

Gas 36 (not shown in FIG. 5) is transmitted to or near distal ends of the legs 58, 60 via respective gas injection tubes 62, 64 extending through the legs. Each of the gas injection tubes 62, 64 is in communication with the annulus 40 between the production tubing 26 and the dip tube 28 via respective gas flow paths (see FIG. 6) formed in the Y-connector 54.

Figure 6:
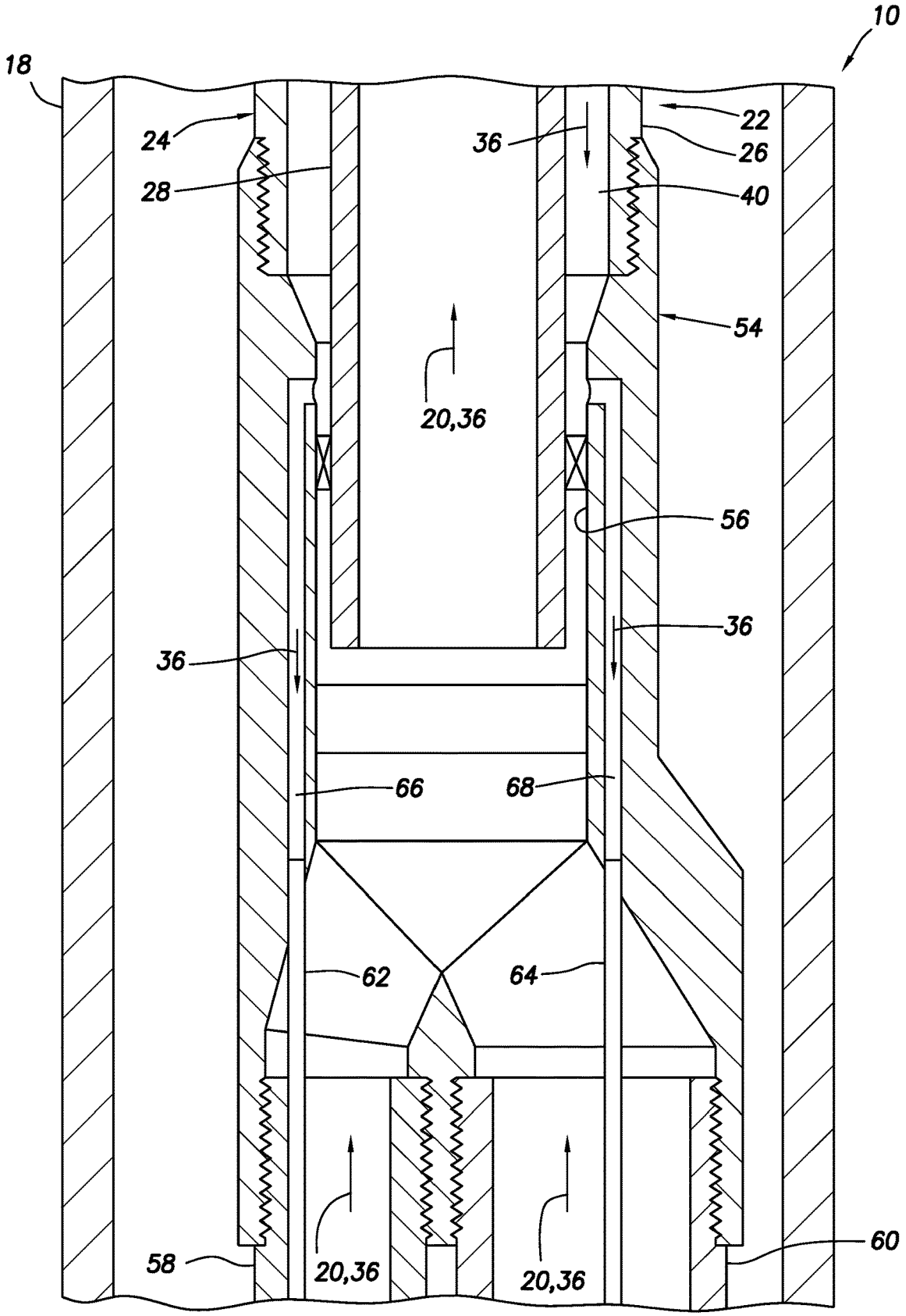
FIG. 6 is a representative partially cross-sectional view of a Y-connector of the FIG. 5 completion string.

Referring additionally now to FIG. 6, an enlarged cross-sectional view of the Y-connector 54 in the gas lift system 22 example of FIG. 5 is representatively illustrated. In this view it may be more clearly seen that gas flow paths 66, 68 are formed in the Y-connector 54.

The gas flow paths 66, 68 are in communication with the annulus 40 and respective ones of the gas injection tubes 62, 64. The gas 36 can flow from the annulus 40, through the gas flow paths 66, 68, then through the gas injection tubes 62, 64 toward the distal ends of the legs 58, 60. Although separate gas flow paths 66, 68 are depicted, a single gas flow path could be used in other examples.

At or near the distal ends of the legs 58, 60, the gas 36 will mix with the well liquids 20 in the intersecting wellbores (not shown in FIG. 6, see FIG. 7), and the combined liquids and gas will flow uphole via the legs 58, 60 and the production tubing 26.

Figure 7:
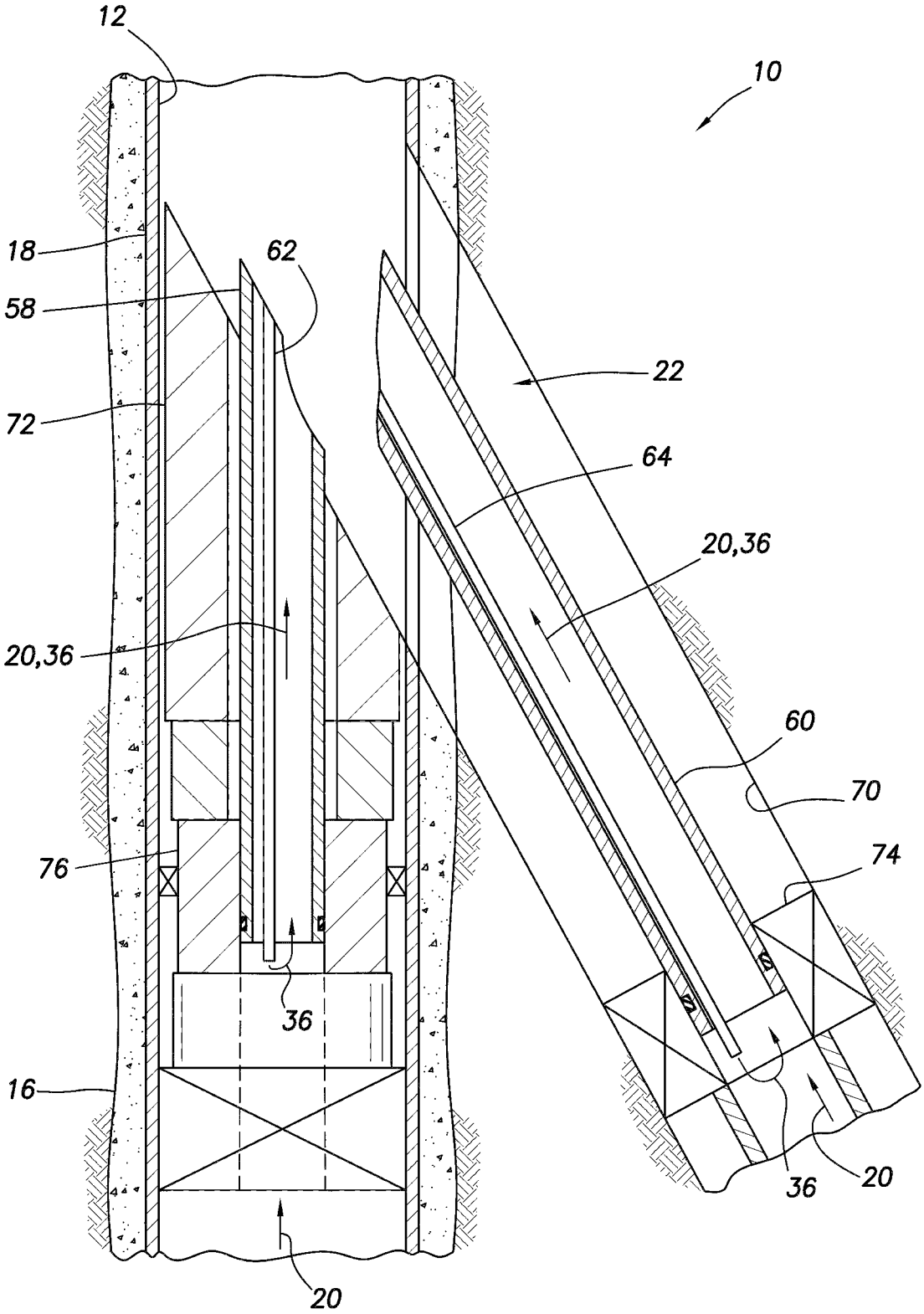
FIG. 7 is a representative partially cross-sectional view of another example of the well system and method, with the FIG. 5 completion string installed therein.

Referring additionally now to FIG. 7, a cross-sectional view of another example of the well system 10 is representatively illustrated. In this example, another wellbore 70 has been drilled from the wellbore 12, so that the wellbores are intersecting.

The leg 60 has been deflected (such as, by a whipstock or deflector 72 positioned in the wellbore 12) into the wellbore 70. In this example, the distal end of the leg 60 is sealingly received in a seal bore of a seal bore receptacle or packer 74 set in the wellbore 70. The gas 36 exits the gas injection tube 64, mixes with the liquids 20 in the wellbore 70, and the combined gas and liquids flow uphole via the leg 60 to the Y-connector 54 for production to the surface via the production tubing as described above.

The leg 58 is inserted through the deflector 72. In this example, the distal end of the leg 58 is sealingly received in a seal bore of a seal bore receptacle or packer 76 set in the wellbore 12 below the deflector 72. The gas 36 exits the gas injection tube 62, mixes with the liquids 20 in the wellbore 12, and the combined gas and liquids flow uphole via the leg 58 to the Y-connector 54 for production to the surface via the production tubing 26 as described above.

In other examples, the legs 58, 60 may be configured differently to sealingly engage other or different components in the respective wellbores 12, 70. The gas injection tubes 62, 64 may extend outwardly from the distal ends of the respective legs 58, 60 or they may be recessed in the legs. Thus, the scope of this disclosure is not limited to any particular details of the well system 10 and gas lift system 22 example as depicted in FIG. 7 or described herein.

It may now be fully appreciated that the present disclosure provides significant advancements to the art of constructing and utilizing gas lift systems. The completion string 54 can be installed as part of an original completion, and then the gas lift valve 44 and inner string 46 can be installed via wireline when the liquids 20 can no longer flow to the surface naturally. In addition, in at least one example, the gas lift valve 44 is positioned uphole of the packer 30, with the gas 36 being injected into the liquids 20 downhole of the packer 30.

The present disclosure provides to the art a gas lift system 22 for use with a subterranean well. In one example, the gas lift system 22 comprises a completion string 24 including a production tubing 26 and a dip tube 28 secured in the production tubing 26, whereby an annulus 40 is formed between the production tubing 26 and the dip tube 28. A gas 36 is injected into the annulus 40, and the gas 36 and well liquids 20 flow into an interior of the dip tube 28.

The completion string 24 may comprise a packer 30 configured to seal against a casing 18 outwardly surrounding the completion string 24, and a side pocket mandrel 34 having a gas lift valve 44 therein. The side pocket mandrel 34 may be positioned uphole of the packer 30.

The completion string 24 may comprise a tubular connector 32 that connects adjacent sections 26*a,b* of the production tubing 26 and secures the dip tube 28 in the production tubing 26. The tubular connector 32 may include a gas flow path 42 in communication with the annulus 40.

The tubular connector 32 may be connected in the production tubing 26 longitudinally between a side pocket mandrel 34 and a packer 30.

An inner string 46 may be received in the completion string 24. The inner string 46 may comprise a packer 50 configured to seal against an interior of the production tubing 26, and a tubular stinger 48 received in at least one of the tubular connector 32 and the dip tube 28.

The completion string 24 may comprise a Y-connector 54 that connects a section 26*a* of the production tubing 26 to first and second tubular legs 58, 60. Distal ends of the first and second tubular legs 58, 60 may be positioned in respective first and second intersecting wellbores 12, 70.

The Y-connector 54 may include first and second gas flow paths 66, 68 formed therein. First and second gas injection tubes 62, 64 may be connected to the respective first and second gas flow paths 66, 68 and extend through the respective first and second legs 58, 60. The dip tube 28 may be sealingly received in the Y-connector 54.

Also provided to the art by the present disclosure is a method of artificially lifting liquids 20 from a subterranean well. In one example, the method can comprise: installing a completion string 24 in the well, the completion string 24 including a production tubing 26, a dip tube 28 received in the production tubing 26, a gas lift valve 44, and a packer 30 downhole of the gas lift valve 44; and flowing a gas 36 into the production tubing 26 via the gas lift valve 44, into an annulus 40 between the production tubing 26 and the dip tube 28, and then into an interior of the dip tube 28.

The method may include connecting a tubular connector 32 between adjacent sections 26*a,b* of the production tubing 26; and securing the dip tube 28 to the tubular connector 32.

The connecting step may comprise connecting the tubular connector 32 longitudinally between the gas lift valve 44 and the packer 30. The connecting step may comprise connecting the tubular connector 32 downhole of the packer 30.

The flowing. step may comprise flowing the gas 36 through a gas flow path 42 formed in the tubular connector 32. The gas flow path 42 may be in communication with the annulus 40.

The method may include installing an inner string 46 within the completion string 24, the inner string 46 comprising a packer 50 and a tubular stinger 48; inserting the tubular stinger 48 into at least one of the tubular connector 32 and the dip tube 28; and setting the packer 50, thereby sealing the packer 50 against an interior of the production tubing 26.

Another example of the gas lift system 22 can comprise: a completion string 24 including a gas lift valve 44, a production tubing 26, a tubular connector 32 connected between adjacent sections 26*a,b* of the production tubing 26, and a dip tube 28 secured in the production tubing 26 and connected to the tubular connector 32. An annulus 40 is formed between the production tubing 26 and the dip tube 28, and a gas 36 flows from the gas lift valve 44 to the annulus 40 via a gas flow path 42 formed in the tubular connector 32.

The completion string 24 may include a packer 30 configured to seal against a casing 18 outwardly surrounding the completion string 24, and a side pocket mandrel 34 having the gas lift valve 44 therein. The side pocket mandrel 34 may be positioned uphole of the packer 30. The tubular connector 32 may be connected in the production tubing 26 longitudinally between the side pocket mandrel 34 and the packer 30.

An inner string 46 may be received in the completion string 24. The inner string 46 may include a packer 50 configured to seal against an interior of the production tubing 26, and a tubular stinger 48 received in at least one of the tubular connector 32 and the dip tube 28.

The completion string 24 may include a Y-connector 54 that connects a section 26*a* of the production tubing 26 to first and second tubular legs 58, 60. Distal ends of the first and second tubular legs 58, 60 may be positioned in respective first and second intersecting wellbores 12, 70. The dip tube 28 may be sealingly received in the Y-connector 54.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A gas lift system for use with a subterranean well, the gas lift system comprising:

a completion string including a production tubing and a dip tube secured in the production tubing, whereby an annulus is formed between the production tubing and the dip tube, in which the completion string comprises a tubular connector that connects adjacent sections of the production tubing and secures the dip tube in the production tubing, the tubular connector including a gas flow path in communication with the annulus;

in which the annulus is adapted to receive a gas injected into the annulus, and an interior of the dip tube is adapted to receive well liquids and the gas.

2. The gas lift system of claim 1, in which the completion string comprises a packer configured to seal against a casing outwardly surrounding the completion string, and a side pocket mandrel having a gas lift valve therein, and in which the side pocket mandrel is positioned uphole of the packer.

3. The gas lift system of claim 1, in which the tubular connector is connected in the production tubing longitudinally between a side pocket mandrel and a packer.

4. The gas lift system of claim 1, in which an inner string is received in the completion string, the inner string comprising a packer configured to seal against an interior of the production tubing, and a tubular stinger received in at least one of the tubular connector and the dip tube.

5. The gas lift system of claim 1, in which the completion string comprises a Y-connector that connects a section of the production tubing to first and second tubular legs, distal ends of the first and second tubular legs being positioned in respective first and second intersecting wellbores.

6. The gas lift system of claim 5, in which the Y-connector includes first and second gas flow paths formed therein, and in which first and second gas injection tubes are connected to the respective first and second gas flow paths and extend through the respective first and second legs.

7. The gas lift system of claim 5, in which the dip tube is sealingly received in the Y-connector.

8. A method of artificially lifting liquids from a subterranean well, the method comprising:

installing a completion string in the well, the completion string including a production tubing, a dip tube received in the production tubing, a gas lift valve, and a packer downhole of the gas lift valve;

connecting a tubular connector between adjacent sections of the production tubing;

securing the dip tube to the tubular connector; and flowing a gas into the production tubing via the gas lift valve, into an annulus between the production tubing and the dip tube, and then into an interior of the dip tube.

9. The method of claim 8, in which the connecting comprises connecting the tubular connector longitudinally between the gas lift valve and the packer.

10. The method of claim 8, in which the connecting comprises connecting the tubular connector downhole of the packer.

11. The method of claim 8, in which the flowing comprises flowing the gas through a gas flow path formed in the tubular connector, the gas flow path being in communication with the annulus.

12. The method of claim 8, further comprising:

installing an inner string within the completion string, the inner string comprising a packer and a tubular stinger;

inserting the tubular stinger into at least one of the tubular connector and the dip tube; and setting the packer, thereby sealing the packer against an interior of the production tubing.

13. A gas lift system for use with a subterranean well, the gas lift system comprising:

a completion string including a gas lift valve, a production tubing, a tubular connector connected between adjacent sections of the production tubing, and a dip tube secured in the production tubing and connected to the tubular connector, whereby an annulus is formed between the production tubing and the dip tube; and in which the annulus is adapted to receive a flow of gas from the gas lift valve to the annulus via a gas flow path formed in the tubular connector.

14. The gas lift system of claim 13, in which the completion string comprises a packer configured to seal against a casing outwardly surrounding the completion string, and a side pocket mandrel having the gas lift valve therein, and in which the side pocket mandrel is positioned uphole of the packer.

15. The gas lift system of claim 13, in which the tubular connector is connected in the production tubing longitudinally between a side pocket mandrel and a packer.

16. The gas lift system of claim 13, in which an inner string is received in the completion string, the inner string comprising a packer configured to seal against an interior of the production tubing, and a tubular stinger received in at least one of the tubular connector and the dip tube.

17. The gas lift system of claim 13, in which the completion string comprises a Y-connector that connects a section of the production tubing to first and second tubular legs, distal ends of the first and second tubular legs being positioned in respective first and second intersecting wellbores.

18. The gas lift system of claim 17, in which the dip tube is sealingly received in the Y-connector.

* * * * *